US006792299B2

(12) United States Patent
Ye

(10) Patent No.: US 6,792,299 B2
(45) Date of Patent: Sep. 14, 2004

(54) DEVICE APPROXIMATING A SHUNT CAPACITOR FOR STRIP-LINE-TYPE CIRCUITS

(75) Inventor: Shen Ye, Cupertino, CA (US)

(73) Assignee: Conductus, Inc., Sunnyvale, CA (US)

( * ) Notice: Subject to any disclaimer, the term of this patent is extended or adjusted under 35 U.S.C. 154(b) by 3 days.

(21) Appl. No.: 09/814,271

(22) Filed: Mar. 21, 2001

(65) Prior Publication Data

US 2002/0158704 A1 Oct. 31, 2002

(51) Int. Cl.[7] ..... H01P 1/203; H01B 12/02

(52) U.S. Cl. ..... 505/210; 333/99 S; 333/219; 333/204; 333/185; 505/700; 505/701; 505/866

(58) Field of Search ..... 333/99 S, 115, 333/185, 204, 219; 505/210, 700, 701, 866

(56) References Cited

U.S. PATENT DOCUMENTS

| | | | | |
|---|---|---|---|---|
| 3,566,315 A | | 2/1971 | Vinding | 333/204 |
| 4,313,097 A | | 1/1982 | de Ronde | 333/204 |
| 4,560,963 A | | 12/1985 | Sharpe | 333/172 |
| 5,055,809 A | | 10/1991 | Sagawa et al. | 333/219 |
| 5,381,117 A | * | 1/1995 | Okamura et al. | 333/219 X |
| 5,485,131 A | | 1/1996 | Fajen et al. | 333/202 |
| 5,703,546 A | * | 12/1997 | Takahashi et al. | 333/219 X |
| 5,922,650 A | | 7/1999 | Ye | 505/210 |
| 6,064,281 A | | 5/2000 | Sheen | 333/175 |
| 6,072,205 A | | 6/2000 | Yamaguchi et al. | 257/277 |

FOREIGN PATENT DOCUMENTS

| | | |
|---|---|---|
| JP | 56 168401 | 12/1981 |
| JP | 08 046412 | 2/1996 |
| JP | 09 139612 | 5/1997 |

OTHER PUBLICATIONS

Schmidt, M.S. et al "Measured Performance at 77K of Superconducting Microstrip Resonators and Filters"; *IEEE Transactions on Microwave Theory and Technique,* vol. 39, No. 9, pp 1475–1479, Sep. 1991.*

* cited by examiner

*Primary Examiner*—Benny T. Lee
(74) *Attorney, Agent, or Firm*—Merchant & Gould P.C.

(57) ABSTRACT

A closed conductive loop for use in planar circuits to realize shunt capacitors instead of conductive patches is disclosed. The closed conductive loop may be formed on a planar substrate or extend to multiple conductive layers in a multi-layer circuit. The use of closed conductive loops as shunt capacitors offers possibilities of more flexible circuit layout, reduced circuit footprint and comparable or improved performance as compared to using conductive patches as shunt capacitors.

18 Claims, 12 Drawing Sheets

DEVICE APPROXIMATING A SHUNT CAPACITOR FOR STRIP-LINE-TYPE CIRCUITS

BACKGROUND OF THE INVENTION

1. Field of the Invention

The present invention relates generally to strip-line-type circuits, more particularly to loop transmission lines as shunt capacitors used in such circuits.

2. Description of the Related Art

Capacitors are one of the basic building blocks for electronic and microwave circuits. In microwave engineering, strip-line-type circuits, including microstrip, strip-line, and multi-layer circuits, can use large metal conductor patches to approximate shunt capacitors. Such patch capacitors can be found, for example, in bias networks of amplifiers, microstrip low pass filters, and matching networks.

As with parallel plate capacitors, the capacitance realized from conductive patches on a microstrip circuit is directly proportional to the area of the patches and the dielectric constant of the substrate. Examples of microstrip patch capacitors are shown in FIG. 1. These patch capacitors can occupy a significant amount of surface area, depending on the amount of capacitance required and the type of the substrate used. Use of conductive patch shunt capacitors thus places significant limitations on the layout flexibility and minimum sizes of circuits.

It is thus desirable to construct shunt capacitors that offer more layout options or potential for more compact circuit design or both. The present invention is directed to achieve one or more of these goals.

SUMMARY OF THE INVENTION

In accordance with the principles of the invention, a strip-line-type circuit includes a shunt capacitor that includes a closed conductive loop. The circuit may further include a transmission line connected to the closed conductive loop. The transmission line may be connected to the closed conductive loop at two nodes, in which case the closed conductive loop is divided into two segments, connected in parallel at the two nodes. The impedance of one of the two segments may be substantially larger than the impedance of the other segment, as in the case, for example, where one segment is substantially longer than the other.

The closed conductive loop may be a layer of conductive thin-film pattern formed on a layer of dielectric material, including a loop made of a superconductor such as $YBa_2Cu_3O_{7-d}$ (YBCO) formed on a magnesium oxide, sapphire or lanthanum aluminate substrate.

The circuit may be a multi-layer circuit in which the closed conductive loop extends to multiple layers of conductive patterns.

The closed loop may take on a variety of shapes, including circular, rectangular and swirl shapes.

More particularly, the circuit may be a filter that includes an inductor with each of its ends connected to a closed conductive loop that acts as a shunt capacitor. The filter may include multiple inductors connected in series, with the junctions between the inductors connected to shunt capacitors realized by closed conductive loops.

The filter may be constructed from a variety of materials, including the above-listed examples. For example, the filter may a band-stop filter having five or more poles constructed from YBCO film on a magnesium oxide substrate no larger than about 50 mm in any dimension.

BRIEF DESCRIPTION OF THE DRAWINGS

Other objects and advantages of the invention will become apparent upon reading the following detailed description and upon reference to the drawings in which.

Figure 1A:
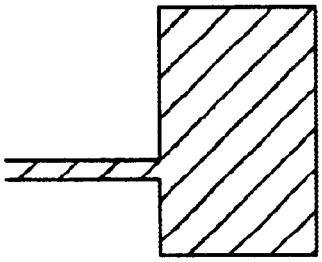
FIGS. 1(*a*), 1(*b*), 1(*c*) and 1(*d*) show shunt capacitors using microstrip metal patches.
Figure 1B:
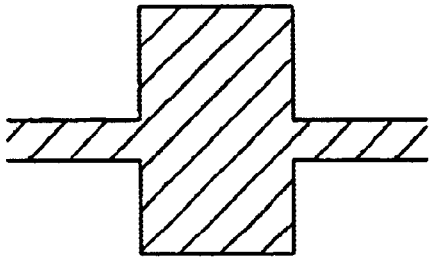
Figure 1C:
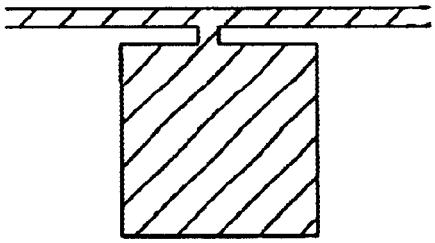
Figure 1D:
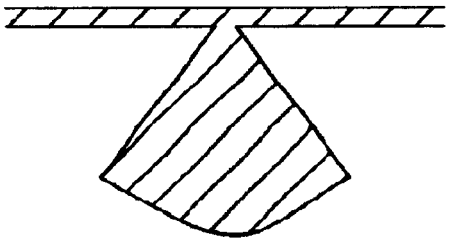

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nonetheless be a routine undertaking for those of ordinary skill in the art having the benefit of this disclosure.

Figure 2:
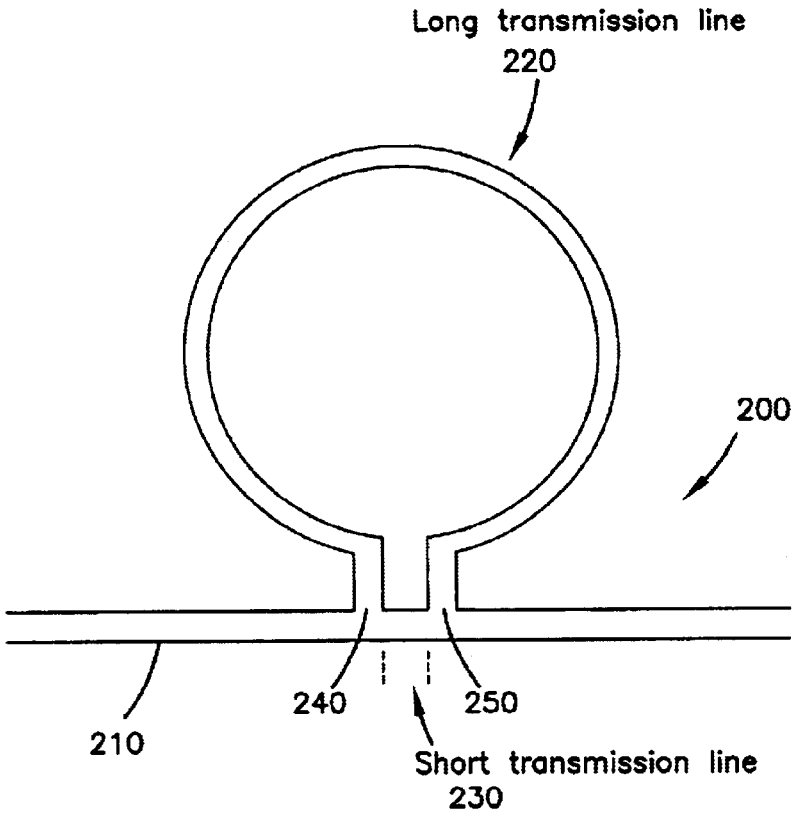
FIG. 2 shows a loop transmission line of this invention on a single layer microstrip.

Referring to FIG. 2, one of the simplest embodiments of the invention is a circuit that includes a shunt capacitor realized by a closed conductive loop 200 and a transmission line 210 attached to the loop 200. The transmission line 210 in this case is connected to the loop 200 at two nodes 240 and 250. The loop 200 can thus be viewed as including two segments 220 and 230 of transmission lines connected in parallel at the nodes 240 and 250. One of the transmission lines 230 (labeled "Short transmission line") has nearly zero, but not zero, electrical length, while the other 220 (labeled "Lone transmission line") has a larger electrical length selected to approximate the desired capacitance. The electrical length of the transmission line 200 is realized by selection of the physical width and length of the line. The longer segment 220 preferably has a substantially higher impedance than the shorter segment 230.

Figure 3:
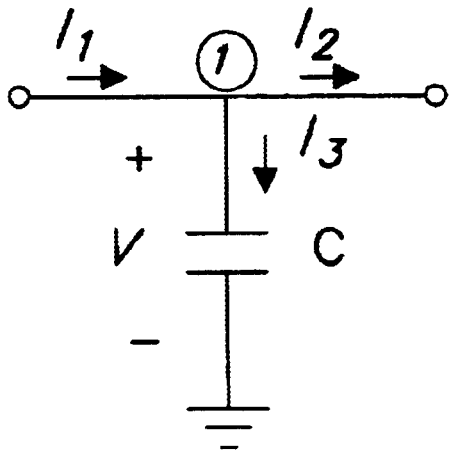
FIG. 3 shows an idea lumped element shunt capacitor equivalent circuit.

Referring to FIG. 3, the principles of the invention can be illustrated as follows. (It should be noted that "+" and "−", as used in FIGS. 3 and 4, refer to the polarity of the voltages V (FIG. 3). V1 (FIG. 4), and V2 (FIG. 4), respectively.) From FIG. 3, which shows the equivalent circuit of an ideal shunt capacitor with a capacitance C and a voltage V across it, one has $$I_2 = I_1 - I_3 \tag{1}$$

where $I_3$ (FIG. 3) is the current following through C from node 1 to ground. That is, the output current $I_2$ is the difference between input current $I_1$ and $I_3$ (FIG. 3) of capacitor C.

Figure 4:
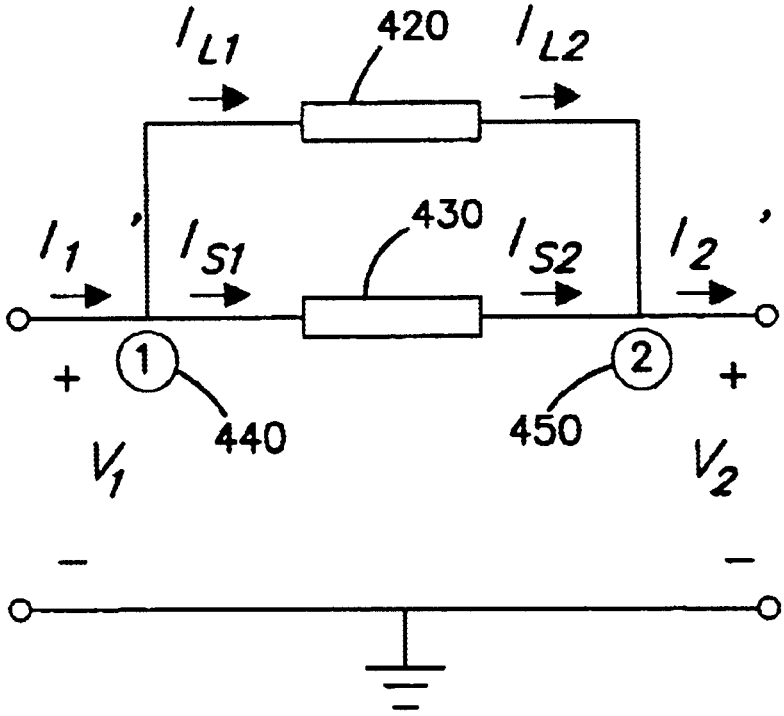
FIG. 4 shows the equivalent circuit of the loop transmission line shown in FIG. 2.

In FIG. 4, which shows an equivalent circuit of the circuit in FIG. 2, the longer segment 220 is represented by an ideal transmission line 420, and the shorter segment 230 by another ideal transmission line 430. $V_1$ and $V_2$ are the voltages from node 1 (440) and node 2 (450) to the ground, respectively. Because the electrical length of the transmission line 230 is nearly zero, $V_1 \approx V_2$ and $I_{S1} \approx I_{S2}$. The output current, $I'_2$, is therefore $$\begin{aligned} I'_2 &= I_{S2} + I_{L2} \\ &\approx I_{S1} + I_{L2} \\ &= I'_1 - I_{L1} + I_{L2} \\ &= I'_1 - (I_{L1} - I_{L2}) \end{aligned} \tag{2}$$

Comparing Equations (1) and (2), one may select appropriate length and impedance of the long transmission line 220, such that $$(I_{L1} - I_{L2}) \approx I_3 \tag{3}$$

at a given frequency or frequency band of interest ("$I_3$" refers to the current identified in FIG. 3). The result is a closed conductive loop that electrically behaves substantially like a patch shunt capacitor.

One advantage in designing circuits based on the principles of the invention is layout flexibility because the conductive loop may take on a variety of shapes. In addition, accurate computer simulations (using, for example, the em software package from Sonnet Software, Inc., Liverpool, N.Y.) have shown that for a narrow band approximation of a microstrip type circuit, using a loop-transmission line to replace a patch shunt capacitor may effectively reduce the area occupied by the circuit.

The circuit based on the principles of the invention may be made of a variety of conductive materials formed on a dielectric layer. Suitable conductive materials include metals such as copper or gold, superconductors such as, niobium or niobium-tin, and oxide superconductors, such as YBCO. Any suitable dielectric material may be used. Examples include alumina, DUROID (a dielectric), magnesium oxide, sapphire or lanthanum aluminate. Methods of deposition of metals and superconductors on substrates and of fabricating devices are well known in the art, and are similar to the methods used in the semiconductor industry.

Figure 5A:
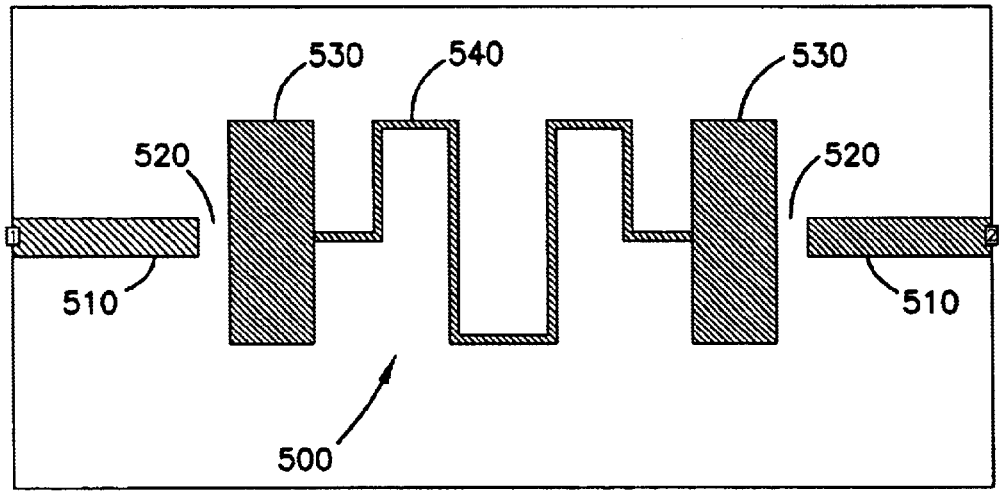
FIGS. 5(*a*) and 5(*b*) show, respectively, a single resonator microstrip circuit with shunt patch capacitors and its simulated frequency response curve.
Figure 5B:
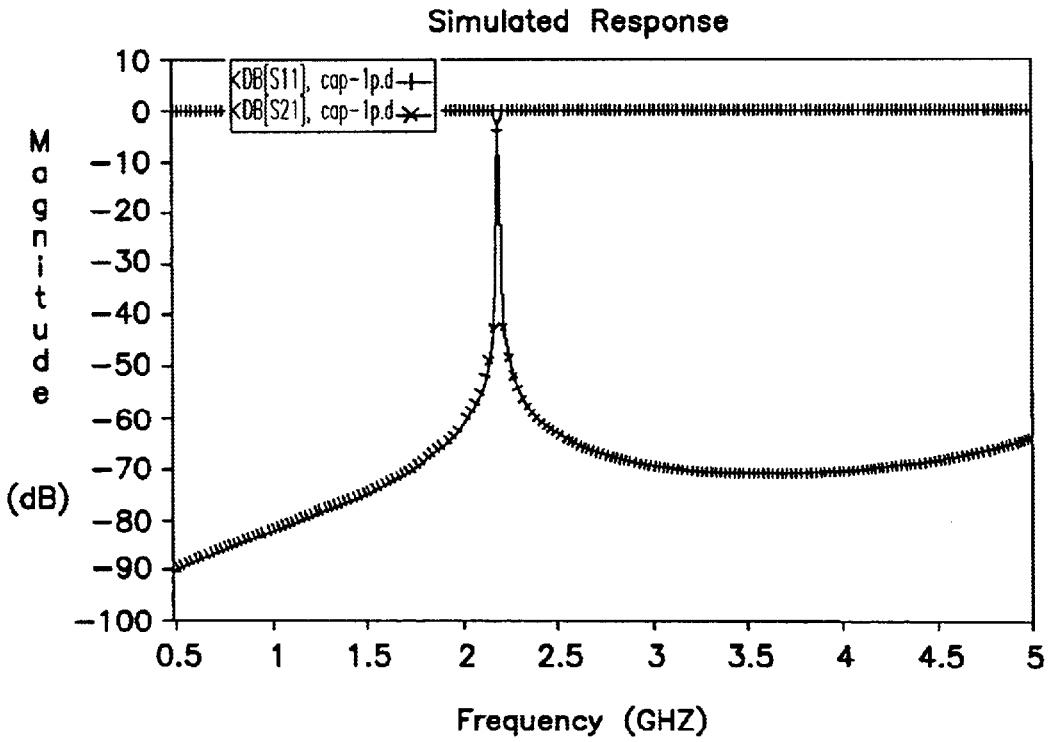
Figure 6A:
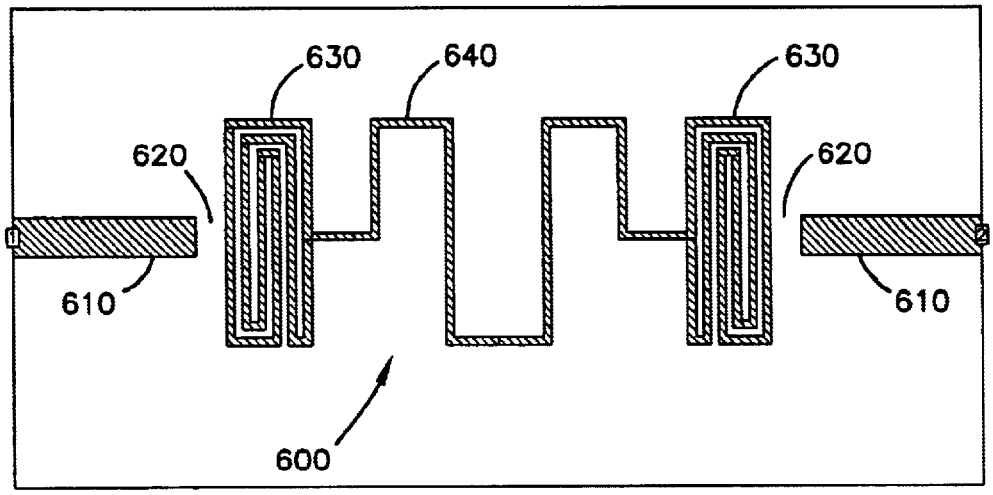
FIGS. 6(*a*) and 6(*b*) show, respectively, a resonator microstrip circuit similar to that shown in FIG. 5(*a*) but using a loop transmission line of this invention, and the simulated frequency response for the circuit in FIG. 6(*a*).
Figure 6B:
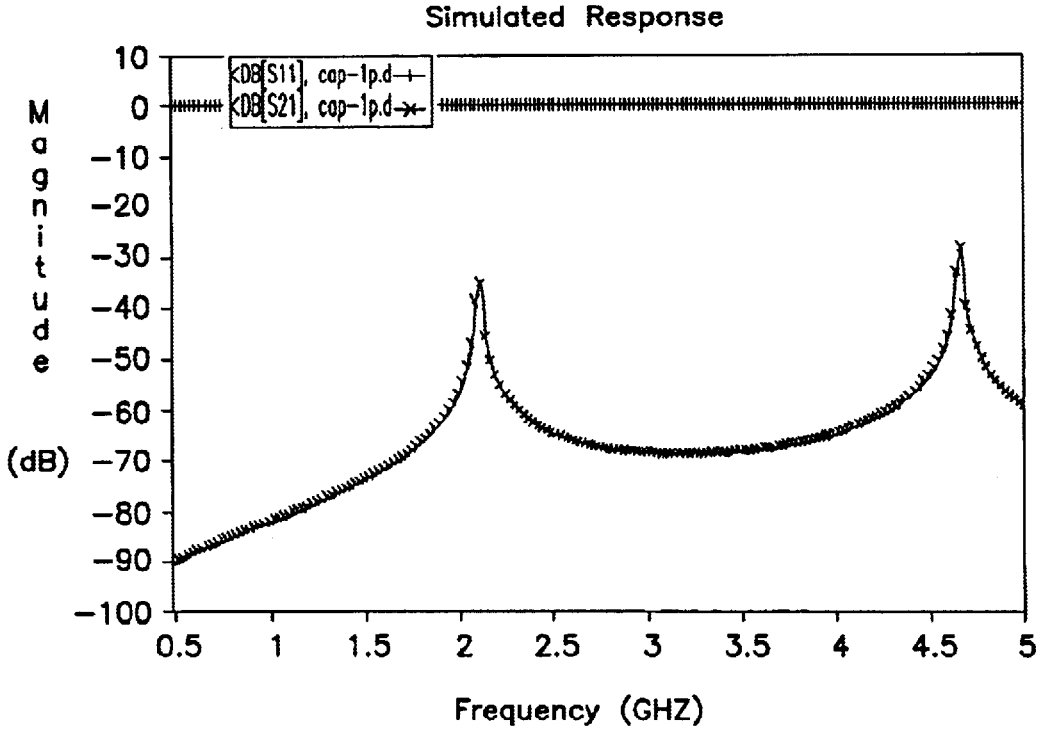

Referring to FIGS. 5(*a*) and 5(*b*) and 6(*a*) and 6(*b*), a single resonator designed based on the principles of the invention is illustrated (FIGS. 6(*a*) and 6(*b*)) and compared with a single resonator design using patch shunt capacitors (FIGS. 5(*a*) and 5(*b*)). The microstrip filter 500 in FIG. 5(*a*) includes two transmission line segments 510 at the two ends (the input and the output). Between the two segments 510 and separated therefrom by gaps 520 are two conductive patches 530 connected by a zigzag transmission line 540. The patches 530 primarily function as shunt capacitors, and the transmission line 540 primarily functions as an inductor. In the embodiment shown in FIG. 5(*a*), the substrate has a size of 512×256 mils, thickness 20 mils and dielectric constant about 10.

Shown in FIG. 6(*a*), the circuit 600 constructed based on the principles of the invention includes shunt capacitors that are realized by the closed conductive loops 630. The rest of the circuit 600, including the transmission line segments 610, gaps 620 and inductor 640, are similar to their counterparts in FIG. 5(*a*). The circuit 600 is constructed on the same substrate as the circuit 500 shown in FIG. 5(*a*).

FIGS. 5(*b*) and 6(*b*) show, respectively, the simulated frequency response curves of the circuits shown in FIGS. 5(*a*) and 6(*a*). Both responses include a dominant resonant mode around 2.1 GHz. Where they differ significantly is in the harmonics: The first harmonic for the circuit in FIG. 5(*a*) is higher than 5 GHz, whereas the first harmonic for the circuit shown in FIG. 6(*a*) is around 4.6 GHz. Thus, the circuit using closed conductive loops (i.e. FIG. 6(*a*)) may be an suitable alternative to the circuit using patch shunt capacitors in the frequency range near the first harmonic.

Figure 7A:
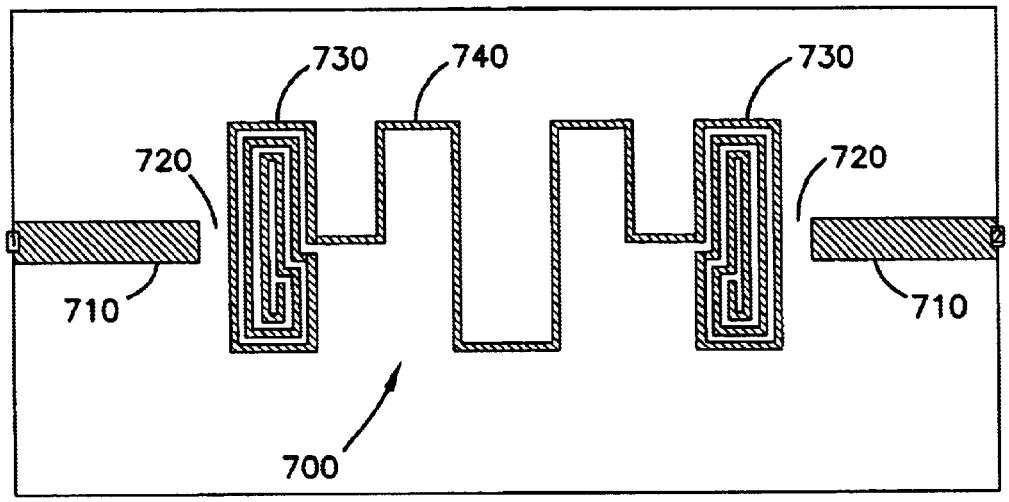
FIGS. 7(*a*) and 7(*b*) show, respectively, a circuit similar to that shown in FIG. 6(*a*) but a with single-ended open stub in place of the closed loops in FIG. 6(*a*), and the simulated frequency response for the circuit in FIG. 7(*a*).
Figure 7B:
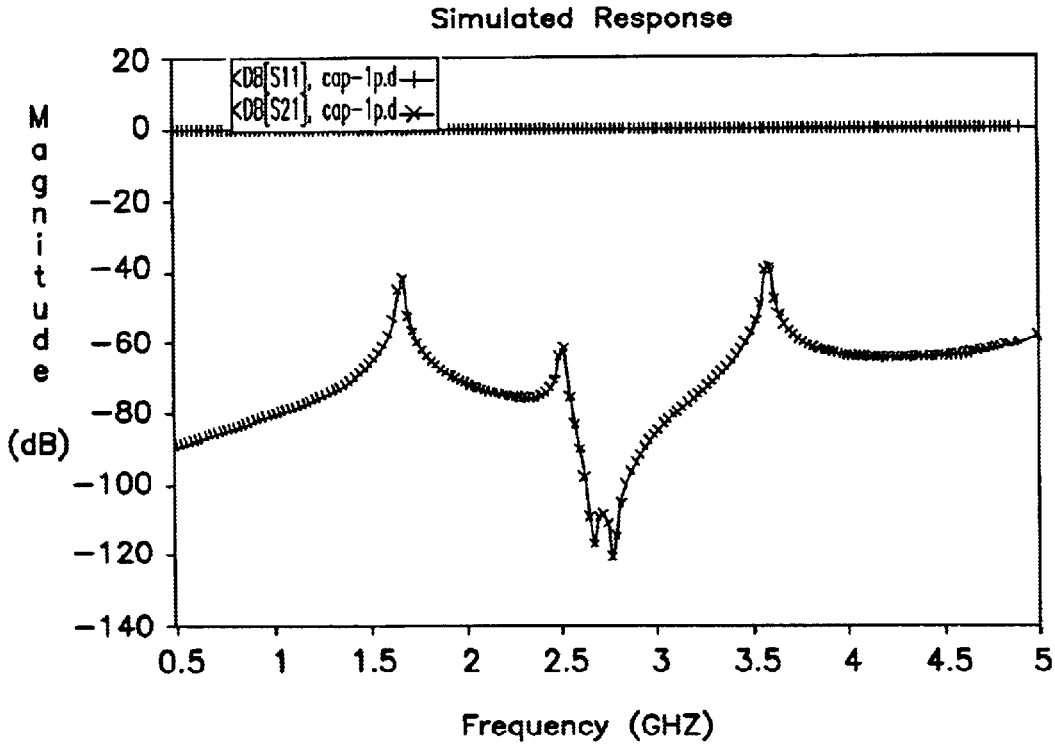

It is worth noting that a closed conductive loop behaves quite differently from conductors of other shapes. For example, the circuit shown in FIG. 7(*a*) is otherwise the same as that in FIG. 6(*a*) except that the closed loops 630 are replaced by a single-open-ended stub 730. The frequency response (FIG. 7(*b*)) of the circuit with the stub is drastically different from that shown in FIG. 6(*b*).

Figure 8A:
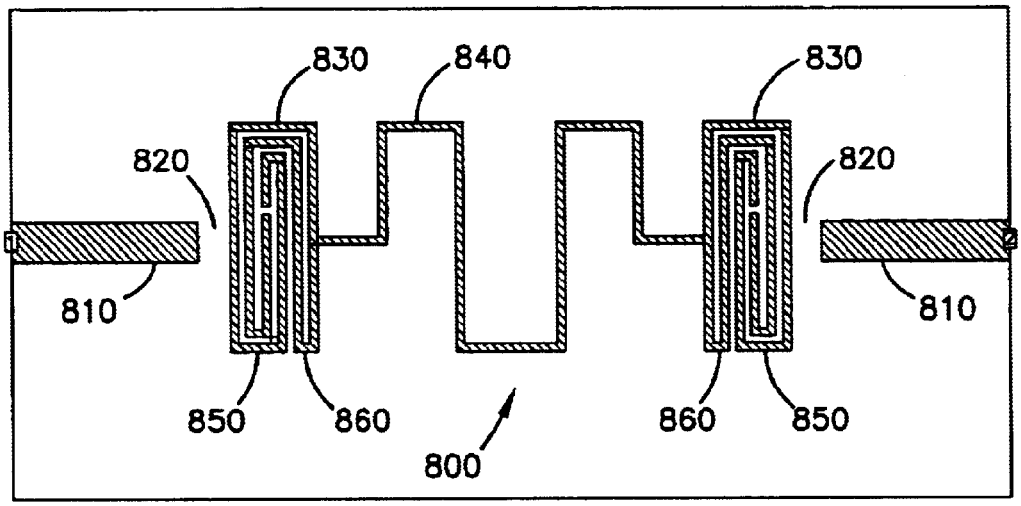
FIGS. 8(*a*) and 8(*b*) show, respectively, a circuit similar to that shown in FIG. 6(*a*) but with double-ended open stubs in places of the closed loops in FIG. 6(*a*), and the simulated frequency response for the circuit in FIG. 8(*a*).
Figure 8B:
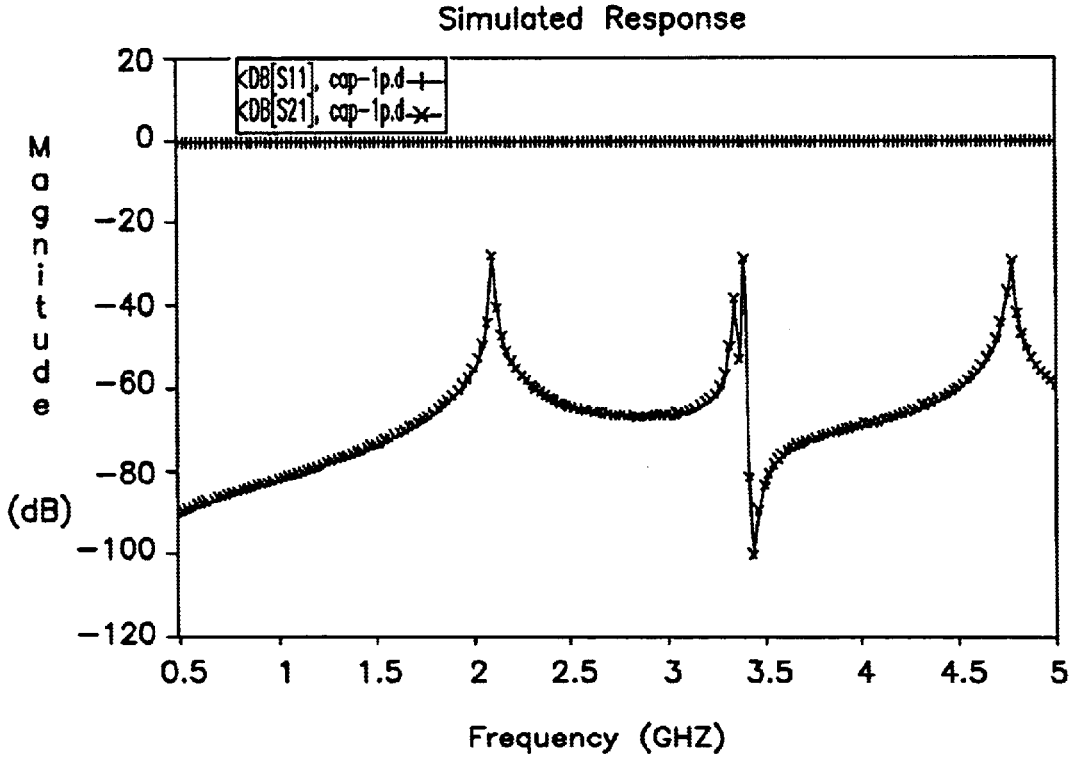

As another example, the circuit shown in FIG. 8(*a*) is otherwise the same as that in FIG. 6(*a*) except that the closed loops 630 are replaced by a pair of open-ended stubs 850 and 860. The frequency response (FIG. 8(*b*)) of the circuit with the stubs is also significantly different from that shown in FIG. 6(*b*). The circuit shown in FIG. 8(*a*) is essentially the one in FIG. 6(*a*) with only a small gap formed in the otherwise closed loop 830. In theory, if the two open-end stubs 850 and 860 are perfectly symmetrical and balanced and each open-end has exactly half length of the loop shown in FIG. 6(*a*), the filter may achieve a frequency response similar to that shown in FIG. 6(*b*). However, it is difficult to realize such perfect symmetry in practice, and the spurious response as shown in FIG. 8(*b*) (for example, near 3.3 GHz) would be difficult to avoid.

Figure 9A:
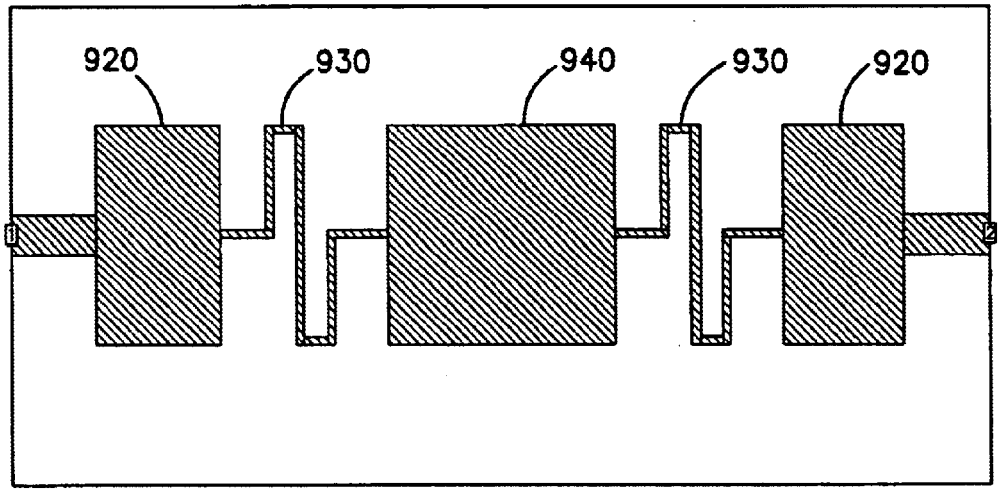
FIGS. 9(*a*) and 9(*b*) show, respectively, a microstrip low-pass filter with shunt patch capacitors, and the simulated frequency response of the circuit.
Figure 9B:
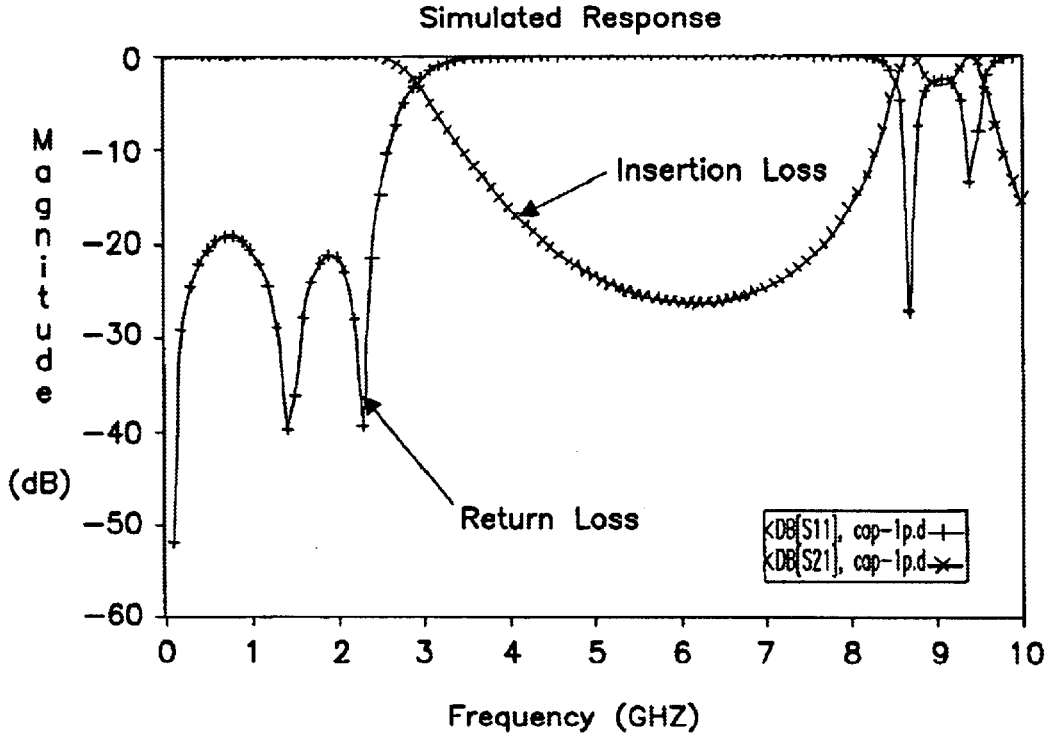
Figure 10A:
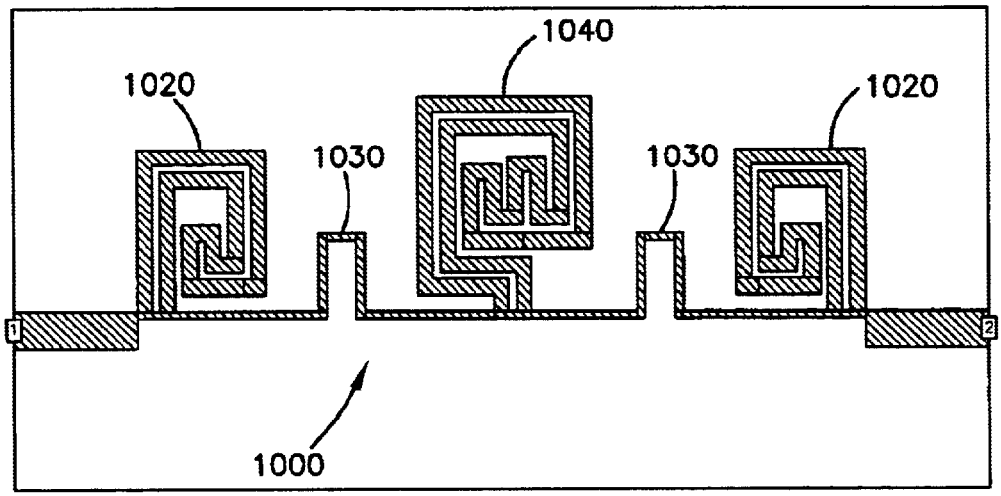
FIGS. 10(*a*) and 10(*b*) show, respectively, a microstrip low-pass filter similar to that shown in FIG. 9(*a*) but using loop transmission line of this invention, and the simulated frequency response for the circuit in FIG. 10(*a*).
Figure 10B:
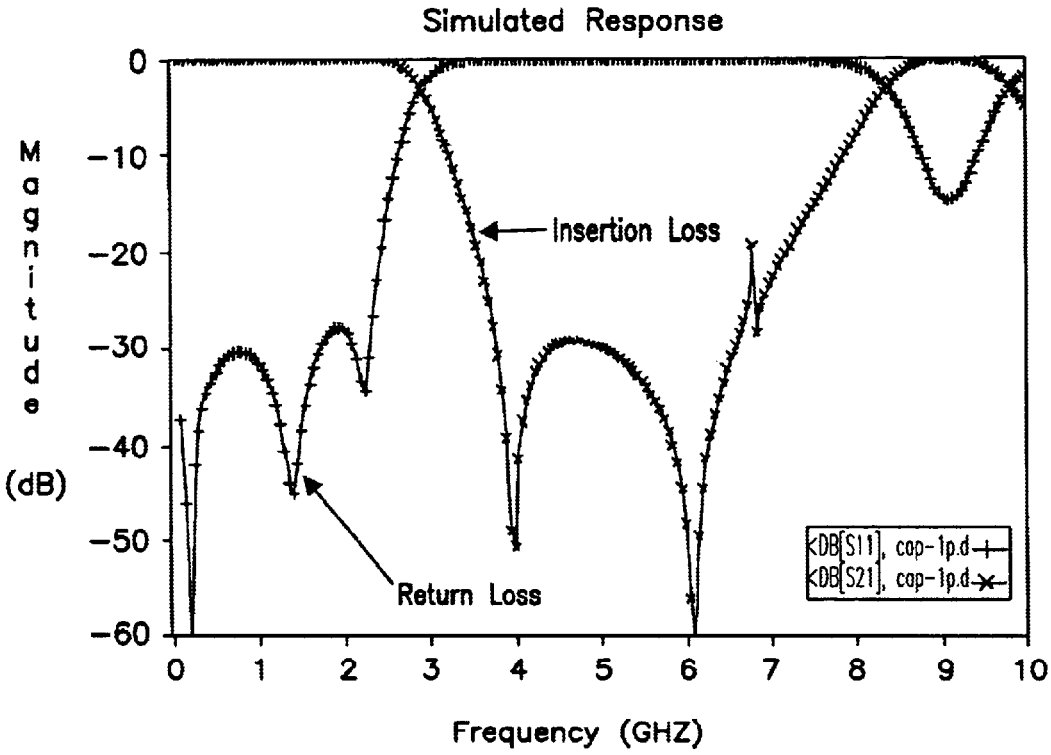

Referring to FIGS. 9(*a*), 9(*b*) and 10(*a*), 10(*b*), a microstrip low-pass filter designed based on the principles of the invention is illustrated (FIG. 10(*a*)) and compared with a design using patch shunt capacitors (FIG. 9(*a*)). The filter 1000, shown in FIG. 10(*a*), includes the closed conductive loops 1020 and 1040, which substitute, respectively, the conductive patches 920 and 940 in the circuit shown in FIG. 9(*a*). The total surface areas occupied by the closed loop capacitors 1020 and 1040 in FIG. 10(*a*) is over 30 percent smaller than that occupied by the patch capacitors 920 and 940 in FIG. 9(*a*). The transmission lines 1030 in the circuit of the invention differ in shape from those 930 in FIG. 9(*a*), but are approximately the same width and total length.

In addition to approximating patch capacitors, close loop capacitors may have other features not available from patch capacitors. FIGS. 9(*b*) and 10(*b*) show, respectively, the simulated frequency response curves of the circuits shown in FIGS. 9(*a*) and 10(*a*). Comparing the responses, both have similar return loss bandwidth, with the filter in FIG. 9(*a*) having 20 dB return loss and the filter in FIG. 10(*a*) having 27 dB return loss. However, the filter in FIG. 10(*a*) produces a much better out-of-band rejection from 3.5 to 6.5 GHz, with steeper slopes on the insertion loss curve Thus, the circuit using closed conductive loops (i.e. FIG. 10(*a*)) may be a preferable alternative to the circuit using patch shunt capacitors.

The principle of the invention is also applicable to multi-layer circuits, i.e., a laminated structure in which multiple layers of conductive patterns are interleaved with dielectric layers. In a multi-layer circuit, the closed conductive loop can be arranged to extend to different layers, offering opportunities for significantly reduced surface area while achieving the same capacitance.

Figure 11:
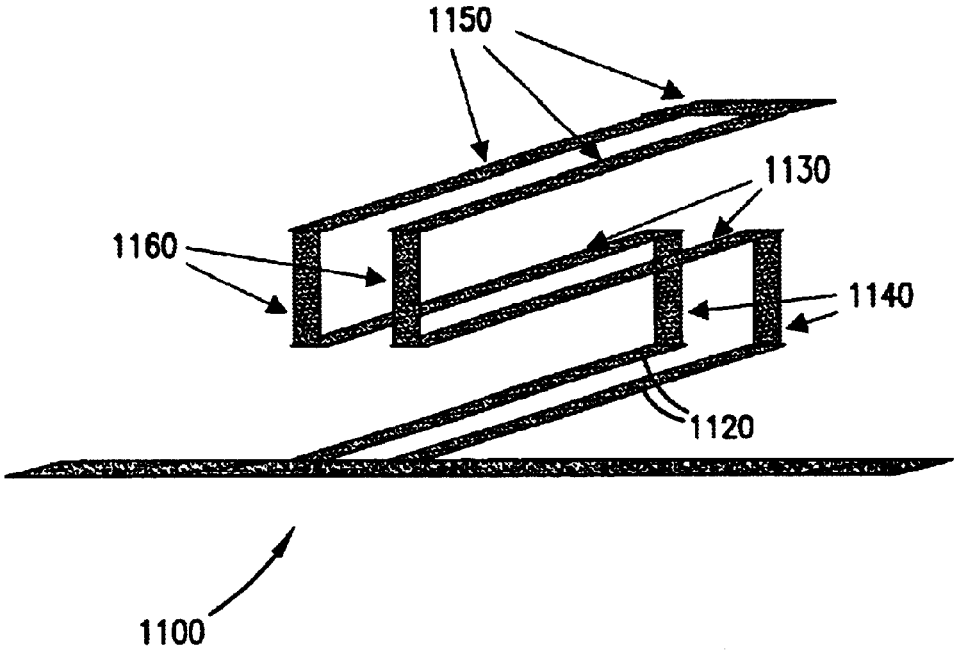
FIG. 11 shows a sample layout schematic drawing of loop transmission line of this invention in a multi-layer structure.

FIG. 11 illustrates a shunt capacitor realized by a closed conductive loop in a multilayer structure. In the particular embodiment, the loop 1100 extends into three conductive layers separated by dielectric layers (not shown). A first portion 1120 lies in the lower conductive layer; a second portion 1130 lies in the middle layer, with vertical conductive paths 1140 electrically connecting the two portions. A third portion 1150 lies in the top conductive layer, with another pair of vertical conductive paths 1160 connecting the middle 1130 and upper 1150 portions. This multilayer structure dramatically reduces the footprint of the shunt capacitor, In contrast, a patch shunt capacitor in a multilayer configuration would not significantly reduce the footprint of the circuits.

Figure 12:
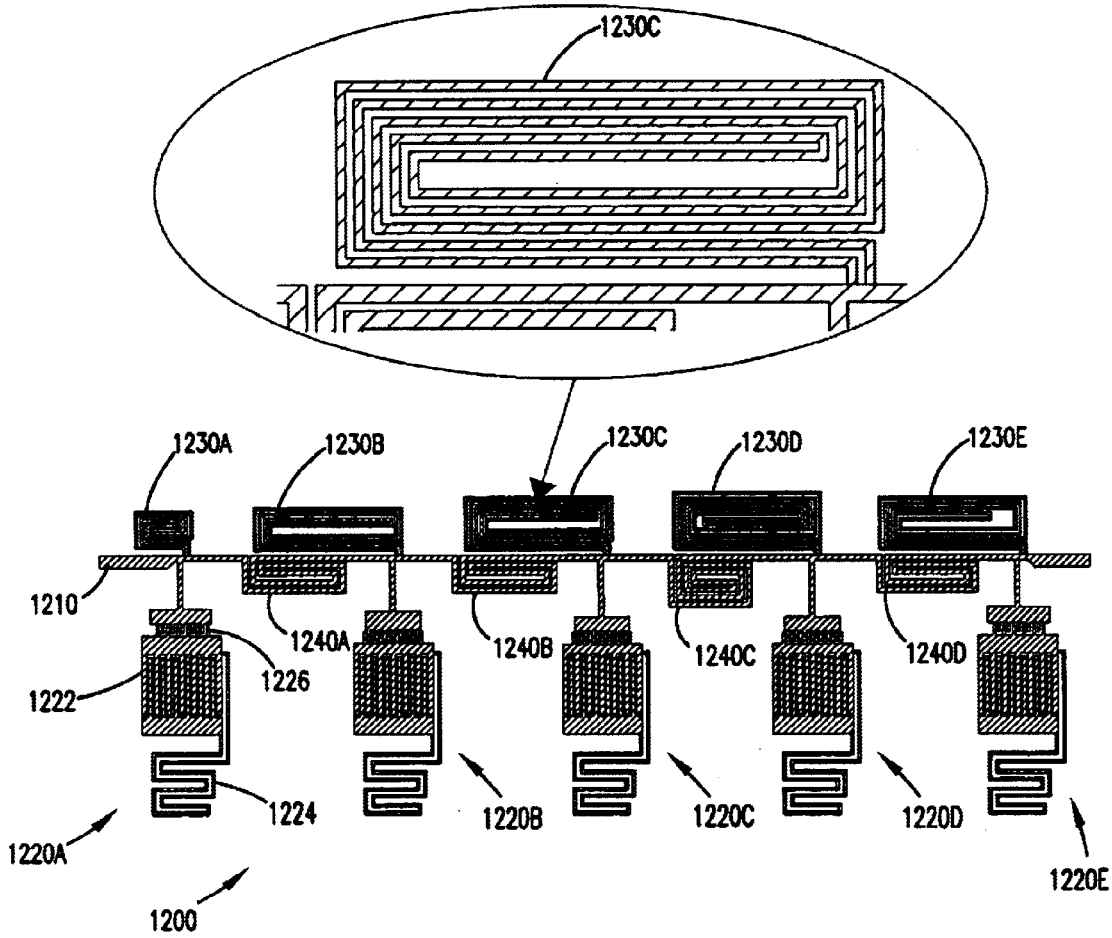
FIG. 12 shows a five-pole band-stop filter using the principles of this invention. The filter is realized on half of an MgO substrate of about 50 mm in diameter and 0.5 mm in thickness.

To further illustrate the principles of the invention, a five-pole band-stop filter built on 20 mil thick MGO substrate with YBCO thin-film high-temperature superconductor is shown in FIG. 12. The filter 1200 includes a transmission line 1210 that includes four serially connected swirl transmission line portions 1240A, 1240B, 1240C and 1240D. The input and output ends of the filter 1200, as well as the junctions between the pairs of adjacent transmission line portions 1240, are connected to their perspective shunt branch resonators 1220A, 1220B, 1220C, 1220D or 1220E, which may be identical to each other. Each shunt branch resonator 1220 includes an interdigitized capacitor 1222 in parallel with an inductor 1224. The parallel combination may also be realized by a frequency-transformed inductor. The resonator is coupled to the transmission line 1210 by a capacitor 1226. The resonators may be of any suitable configuration. Examples of the components, including interdigitized capacitors and frequency-transformed inductors are disclosed in the U.S. patent applications Ser Nos. 08/706974, 09/040578 and 09/699783, which are incorporated herein by reference.

The input and output ends of the filter 1200, as well as at the junctions between pairs of adjacent inductors 1240, are also connected to their respective shunt capacitors 1230A, 1230B, 1230C, 1230D and 1230E, which are realized by closed conductive loops of varying sizes.

As shown in FIG. 12, very compact design may be achieved by using closed conductive loops to realize shunt capacitors. The circuit in this case was constructed within half of an MgO wafer about 50 mm in diameter and 0.5 mm in thickness. Filters of higher orders may also be constructed under such size constraints.

Figure 13:
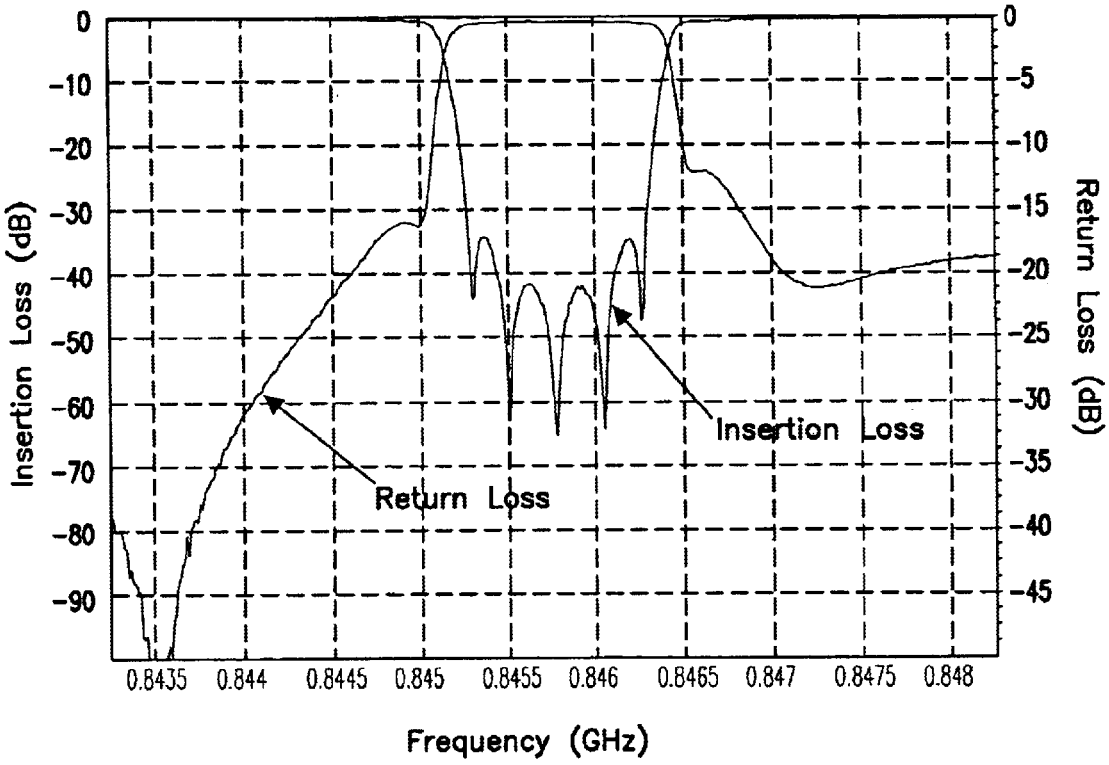
FIG. 13 shows measured results of the five-pole band-stop filter shown in FIG. 12.

The measured response of the five-pole band-stop filter is shown in FIG. 13. The filter's center frequency is at 845.75 MHz, with a bandwidth of about 1.0 MHz.

Thus, by the use of an alternative form of shunt capacitors in planar circuits, the invention offers an opportunity for more flexible circuit layout and more compact circuit size while achieving comparable or superior circuit performance than the designs using conductive patches as shunt capacitors.

The particular embodiments disclosed above are illustrative only, as the invention may be modified and practiced in different but equivalent manners apparent to those skilled in the art having the benefit of the teachings herein. The principles of the invention apply generally to all planar circuits, including microstrip circuits, stripline circuits, and coplanar waveguides. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A strip-line-type circuit comprising a shunt capacitor, the shunt capacitor comprising a closed conductive loop, wherein current may enter or exit the conductive loop through one of two portions of the closed conductive loop, and neither of the two portions is grounded.

2. The circuit as set forth in claim 1, further comprising a transmission line connected to the closed conductive loop.

3. The circuit as set forth in claim 2, wherein the transmission line is connected to the closed conductive loop at two nodes, whereby the closed conductive loop is divided into two segments, each ending at the two nodes, wherein the impedance of one of the two segments is larger than the impedance of the other segment.

4. The circuit as set forth in claim 3, wherein the length of one of the two segments is larger than the length of the other of the two segments.

5. The circuit as set forth in claim 1, wherein the closed conductive loop is at least partially disposed in a dielectric layer.

6. The circuit set forth in claim 5, wherein the circuit is a multi-layer circuit comprising a stack of alternating layers of dielectric material and conductive patterns, and wherein the closed conductive loop is part of at least two of the layers of conductive patterns.

7. The circuit as set forth in claim 5, wherein the closed conductive loop is comprised of a superconductor.

8. The circuit as set forth in claim 7, wherein the superconductor is an oxide superconductor.

9. The circuit as set forth in claim 8, wherein the oxide superconductor comprises YBCO.

10. The circuit as set forth in claim 9, wherein the dielectric material is one of magnesium oxide, sapphire, and lanthanum aluminate.

11. The circuit as set forth in claim 1, wherein the closed loop comprises a swirl-shaped portion.

12. A filter comprising:

a. a transmission line having two conductive leads; and b. a plurality of shunt capacitors as set forth in claim 1, wherein each of the two conductive leads of the transmission line is connected to the closed conductive loop of a selected one of the plurality of shunt capacitors.

13. A filter comprising:

a. a plurality of transmission line portions connected in series; and b. a plurality of shunt capacitors as set forth in claim 1, wherein the junction between at least one pair of adjacent, serially connected transmission line portions is connected to the close conductive loop of one of the plurality of shunt capacitor.

14. The filter as set forth in claim 13, wherein the transmission line portions and capacitors comprise conductive patterns disposed on a layer of a dielectric material.

15. The filter as set forth in claim 14, wherein the conductive patterns are comprised of a superconductor.

16. The filter as set forth in claim 15, wherein the superconductor comprises YBCO and the dielectric material is one of magnesium oxide, sapphire and lanthanum aluminate.

17. The filter as set forth in claim 16, wherein the layer of dielectric material is a magnesium oxide substrate no larger than about 50 mm in any dimension and the filter is a band-stop filter having five or more poles.

18. The filter as set forth in claim 14, further comprising a plurality of resonators connected to the transmission line portions, wherein each of the resonators comprises a frequency transformed inductor.

* * * * *

UNITED STATES PATENT AND TRADEMARK OFFICE

CERTIFICATE OF CORRECTION

PATENT NO. : 6,792,299 B2
DATED : September 14, 2004
INVENTOR(S) : Shen Ye

It is certified that error appears in the above-identified patent and that said Letters Patent is hereby corrected as shown below:

Column 1,
Line 68, after "may" please insert -- be --

Column 2,
Line 25, "but a with" should read -- but with a --

Column 5,
Lines 67 and 68, ", which are incorporated herein by reference" should be deleted.

Signed and Sealed this

Eighth Day of February, 2005

JON W. DUDAS
*Director of the United States Patent and Trademark Office*